United States Patent [19]

Kiriu et al.

[11] Patent Number: 4,845,003

[45] Date of Patent: Jul. 4, 1989

[54] TONER FOR DEVELOPING ELECTROSTATIC LATENT IMAGES AND COMPLEX COMPOUNDS CONTAINING ALUMINUM USABLE THEREIN

[75] Inventors: Takashi Kiriu; Motoomi Arakawa, both of Osaka, Japan

[73] Assignee: Orient Chemical Industries, Ltd., Japan

[21] Appl. No.: 224,466

[22] Filed: Jul. 26, 1988

Related U.S. Application Data

[63] Continuation-in-part of Ser. No. 159,063, Feb. 23, 1988, abandoned.

[30] Foreign Application Priority Data

Feb. 25, 1987 [JP] Japan ..... 62-43628

[51] Int. Cl.[4] ..... G03G 9/08

[52] U.S. Cl. ..... 430/110; 430/107

[58] Field of Search ..... 430/105, 107, 110

[56] References Cited

U.S. PATENT DOCUMENTS

| | | | |
|---|---|---|---|
| 3,681,107 | 8/1972 | Moriconi et al. | 430/107 X |
| 3,900,589 | 4/1975 | Lindblad et al. | 430/107 X |
| 3,916,064 | 10/1975 | Brown | 430/107 X |
| 4,206,064 | 6/1980 | Kiuchi et al. | 430/110 X |
| 4,476,210 | 11/1984 | Croucher et al. | 430/115 X |
| 4,656,112 | 4/1987 | Kawagashi et al. | 430/110 |
| 4,762,763 | 8/1988 | Nomura et al. | 430/110 |

FOREIGN PATENT DOCUMENTS

| | | | |
|---|---|---|---|
| 59-79256 | 5/1984 | Japan | 430/110 |
| 59-88743 | 5/1984 | Japan | 430/110 |

*Primary Examiner*—Paul R. Michl
*Assistant Examiner*—Jeffrey A. Lindeman
*Attorney, Agent, or Firm*—McGlew & Tuttle

[57] ABSTRACT

A toner for developing electrostatic latent images characterized in that the toner comprises an aluminum compound of a hydroxycarboxylic acid which may be substituted with alkyl and/or aralkyl.

12 Claims, No Drawings

TONER FOR DEVELOPING ELECTROSTATIC LATENT IMAGES AND COMPLEX COMPOUNDS CONTAINING ALUMINUM USABLE THEREIN

This is a continuation in part of copending U.S. application Ser. No. 159,063 filed Feb. 23, 1988, now abandoned.

FIELD AND BACKGROUND OF THE INVENTION

The present invention relates to a novel negatively chargeable dry toner for developing electrostatic latent images for use in electrophotography, electrostatic recording, electrostatic printing, etc., as well as to complex compounds usable therein, and more particularly complex compounds of aluminum and aromatic hydrocarboxylic acids having charge control properties for toners.

Electrostatic latent images can be developed into visible images with a toner deposited thereon by electrostatic attraction. Powder developers as well as liquid developers are widely used for developing electrostatic latent images.

Powder developers can be divided generally into two-component developers and single-component developers.

The two-component developer comprises a finely divided toner having a mean particle size of 15 μm and prepared by dispersing a coloring agent, charge control agent, fluidizing agent and the like in a natural or synthetic resin, and a carrier of finely divided iron, ferrite or the like admixed with the toner and 100 to 200 μm in particle size.

The single-component developer comprises only a finely divided toner having a mean particle size of 15 μm and prepared by dispersing a coloring agent, charge control agent, fluidizing agent, magnetic material and the like in a natural or synthetic resin.

Electrostatic latent images are developed with the two-component developer by triboelectrically charging the toner with the carrier and depositing the toner on the latent image. Toners heretofore known and serving as single-component developers include those which are triboelectrically chargeable by a brushlike or plate-like friction member used in place of the carrier and having the same function as the carrier. Further provided in recent years are toners which are triboelectrically chargeable by a finely divided magnetic material which is maintained in a dispersed state. These developing toners are charged positively or negatively in accordance with the polarity of the electrostatic latent image to be developed.

To enable the toner to retain the charge, it is also proposed to utilize the triboelectric chargeability of the resin used as the main component of the toner, but the toner so adapted is low in chargeability and has a great solid surface resistance value. Consequently, the toner image obtained is prone to fogging and to being obscure.

To impart the desired chargeability to toners, it is a practice to add to the toner a charge imparting dye or pigment, and a charge control agent. Presently used in the art are oil-soluble nigrosine dyes for imparting a positive charge to the toner as disclosed in Exampled Japanese Patent Publication No. SHO 41-2427, etc., and metal-containing complex salt dyes for giving a negative charge as disclosed in Examined Japanese Patent Publication Nos. SHO 41-20153, SHO 43-17955 and SHO 45-26478, etc.

However, such dyes or pigments serving as charge control agents are complex in structure and low in stability. For example, they are liable to decompose or degrade, failing to exhibit charge control ability when subjected to mechanical friction and impact, to changes in temperature or humidity or to electric impact, or when exposed to light. Furthermore, they have a substantial defect in that being colored substances, they fail to fulfill the requirement that the charge control agent should be colorless or substantially colorless when it is to be used for a toner of particular color.

Recently, various charge control agents have been disclosed which meet this requirement. Among these, the compounds disclosed in Examined Japanese Patent Publications Nos. SHO 55-42452, SHO 58-41508, SHO 59-7348 and SHO 59-26944 contain chromium, cobalt or like heavy metal, while those disclosed in Unexamined Japanese Patent Publication Nos. SHO 61-69073 and SHO 61-73963 contain zinc. These compounds, however, leave the problem still to be solved of providing a charge control agent free from heavy metal, and which is therefore safer to use than heavy metal containing compounds since the latter by their very nature are deemed to be toxic.

SUMMARY OF THE INVENTION

In view of the foregoing drrawbacks of conventional charge control agents, a main object of the present invention is to provide a toner for developing electrostatic latent images having incorporated therein a compound which is useful as a charge control agent for giving a negative charge to the toner, satisfactorily dispersible in the resin component of the toner, highly amenable to pulverization, resistant to the ambient conditions, free from heavy metal or the like and therefore usable with high safety and which can be regarded as almost colorless.

To fulfill the above object, the present invention provides a toner for developing electrostatic latent images which is characterized in that the toner comprises an aluminum compound of an aromatic hydrocarboxylic acid which is unsubstituted or substituted with alkyl and/or aralkyl.

Another main object of the present invention is to provide complex compounds of aluminum and optionally alkyl and/or aralkyl substituted aromatic hydroxycarboxylic acids having charge control properties for toners.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which preferred embodiments of the invention are illustrated.

DESCRIPTION OF THE PREFERRED EMBODIMENTS

The aluminum compound of an aromatic hydroxycarboxylic acid which is unsubstituted or substituted with alkyl and/or aralkyl for use in the present invention is prepared from an aromatic hydroxycarboxylic acid which is unsubstituted or substituted with alkyl and/or aralkyl, by treating the acid with an aluminum imparting agent by a known method.

The aluminum compound is obtained, for example, by dissolving a hydroxycarboxylic acid in water with addition of a sufficient amount of an alkali, adding an aluminum imparting agent, such as aluminum chloride or aluminum sulfate, to the solution, heating the mixture and adjusting the pH to 3 to 4 for reaction. The resulting precipitate is filtered off, thoroughly washed with water and dried, whereby the desired compound can be obtained. When required, the reaction can be carried out in an organic solvent.

When the aromatic hydroxycarboxylic acid and aluminum are 2:1 in mole ratio, the product may be represented by the following formula:

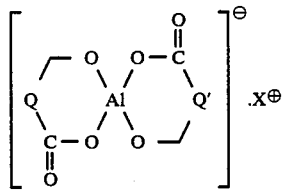

wherein Q and Q' are each an aromatic hydroxycarboxylic acid residue which may be substituted with alkyl and/or aralkyl, and X is a counter ion.

In this case, the counter ion can be changed depending on the condition for the after-treatment of the product. For example, when the reaction mixture is adjusted to a pH of up to 3 before filtration, and the product filtered off is washed until the pH increases to about 6 to about 7, the counter ion is a hydrogen ion. If the pH is adjusted to neutrality or alkalinity with an alkali such as sodium hydroxide or ammonium chloride, the counter ion becomes the corresponding alkali metal ion, ammonium ion $NH_4$, or the like. Further, treatment, for example, with various amine hydrochlorides affords various ammonium salts.

Broadly, the present invention is directed to complex compounds of aluminum and optionally alkyl and/or aralkyl substituted aromatic hydrocarboxylic acids, and the use thereof in the form of toners for developing electrostatic latent images, especially toner compositions comprising a toner resin and a least one said complex compound as charge control agent.

The present invention desirably comprises aluminum complex compounds of the formula $$[Al(Y)_a]^{b-} \cdot X^+{}_b$$

wherein each individual Y is an optionally alkyl and/or aralkyl substituted aromatic hydroxycarboxylic acid radical, i.e. a difunctional or divalent radical, X is a corresponding counter ion such as hydrogen, $NH_4$, an ammonium ion of a primary, secondary or tertiary amine, or a quaternary ammonium ion, a is 2 or 3, and b is 1 when a is 2 and b is 3 when a is 3.

Thus, where a is 2, these compounds have the formula $$[Al(Y)_2]^- \cdot X^+$$

and where a is 3, these compounds have the formula $$[Al(Y)_3]^{3-} \cdot X^+{}_3$$

wherein in each instance Y and X are the same as defined above.

Such complex compounds are colorless or substantially colorless, water insoluble or substantially water insoluble, as well as generally thermally stable, and thus advantageously usable as charge control agents in toners.

More particularly, the present invention contemplates aluminum complex compounds of the formula $$[Al(-O-Ar-COO-)_a]^{b-} \cdot X^+{}_b$$

wherein each individual Ar is an optionally alkyl and/or aralkyl substituted aromatic radical such as a mononuclear or polynuclear aromatic radical, e.g. aryl such as unsubstituted or alkyl and/or aralkyl substituted phenyl or naphthyl, X is a corresponding counter ion such as hydrogen or $NR_4$ wherein each individual R is hydrogen or an organic radical such as alkyl, alkoxyalkyl, cycloalkyl or aralkyl, e.g. phenylalkyl, and a and b are the same as defined above, such that where a is 2, these compounds have the formula $$[Al(-O-Ar-COO-)_2]^- \cdot X^+$$

and where a is 3, these compounds have the formula $$[Al(-O-Ar-COO-)_3]^{3-} \cdot X^+{}_3$$

wherein in each instance Ar and X are the same as defined above.

Examples or aromatic hydrocarboxylic acids which may be substituted with alkyl and/or aralkyl for use in this invention are salicylic acid, alkyl($C_1$–$C_{12}$)-salicylic acids, 3,5-dialkyl($C_1$–$C_{12}$)-salicylic acids, 1-hydroxy-2-naphthoic acid, 2-hydroxy-3-naphthoic acid, 2-hydroxy-1-naphthoic acid, alkyl($C_3$–$C_{12}$)-2-hydroxy-3-naphthoic acids, 6-(alpha-methylbenzyl)-2-hydroxy-3-naphthoic acid, etc., and mixtures thereof.

Examples of primary, secondary and tertiary amines and quarternary ammonium salts which are used in preparing the corresponding complex compounds in which the counter ion is an ammonium ion of an amine, or a quarternary ammonium ion, include primary amines such as tetradecylamine, hexylamine, butylamine, 3-methoxy-1-propylamine, 3-octyloxy-1-propylamine, cyclohexylamine, etc.;

secondary amines such as N-dodecyl-N-ethylamine, N-octyl-N-butylamine, bis(methoxypropyl)amine, etc.;

tertiary amines such as triethylamine, tributylamine, etc.; and quaternary ammonium salts such as tetrabutylammonium chloride, N-benzyl-N,N,N-tri-methylammonium chloride, N-benzyl-N,N,N-tri-butylammonium chloride, etc.

The aluminium compound is incorporated into the toner in a charge control effective amount, such as an amount of 0.1 to 10 parts by weight, preferably 0.5 to 5 parts by weight, per 100 parts by weight of the resin component of the toner. If the amount of the aluminum compound is less than 0.1 part by weight, the advantage of the invention will not be fully available, whereas when it is more than 5 parts by weight, background smudging or fogging is likely to result.

To prepare the toner of the present invention, the aluminum compound is admixed with at least one of known resins for use in toners, i.e. binder resins for dry toners such as styrene resin, styrene-acrylic resin, styrene-butadiene resin, epoxy resin, polyester resin and paraffin wax. The resin to be used is selected-acrylic resin, styrene-butadiene resin, epoxy resin, polyester resin and paraffin wax. The resin to be used is selected suitably in view of the adhesion, storage stability and flowability of the toner, the amenability of the toner composition to pulverization, etc.

The toner of the present invention may have incorporated therein other additives including, for example, lubricants such as Teflon and zinc stearate, flowability imparting agents such as colloidal silica, titanium oxide and aluminum oxide, anticaking agents, electrical conductivity imparting agents such as carbon black and tin oxide, and auxiliary fixing agents such as low-molecular-weight polyethylene.

While a wide variety of known dyes and pigments are usable as coloring agents, those especially suited for use in toners for color copies are carbon black, nigrosine dyes, Aniline Black, Benzidine Yellow, Hansa Yellow, chrome yellow, Rhodamine 6G Lake, quaniacridone, Rose Bengale, phthalocyanine dyes or pigments including Phthalocyanine Blue B and Phthalocyanine Green, ultramarine, anthraquinone dyes, various dyes soluble in organic solvents, etc.

Although the toner of the invention is usually admixed with a carrier to provide a two-component developer, the toner is of course usable as a single-component developer.

The present invention will be described below in greater detail with reference to specific preparation examples and examples, in which the parts are all by weight.

PREPARATION EXAMPLE 1

Preparation of aluminum compound of 3,5-ditertiary-butylsalicylic acid (2:1 in acid/Al mole ratio)

A 50 g (0.2 mole) quantity of 3,5-ditert-butylsalicylic acid was added to a solution of 8 g (0.2 mole) of NaOH in 500 mm of water, and the mixture was heated to about 60° C. to completely dissolve the acid. An aqueous solution of 17.1 g (0.05 mole) of aluminum sulfate in 200 ml of water was slowly added dropwise to the acid solution. The mixture was there-after stirred at about 95° C. for 30 minutes, then adjusted to a pH of about 3 and cooled to about 40° C. The cooled reaction mixture was filtered, and the resulting product was washed with water until the pH of the washings was adjusted to neutrality. The washed product was dried at 90° C., giving about 35 g of a white powder (Compound Example (1) given below).

PREPARATION EXAMPLE 2

Preparation of aluminum compound of 3,5-ditert-butylsalicylic acid and 2-hydroxy-3-naphthoic acid A 17.1 g (0.05 mole) quantity of aluminum sulfate was dissolved in 800 g of water, 25 g (0.1 mole) of 3,5-ditert-butylsalicylic acid was added to the solution, and the mixture was heated to 90° to 90° C. with stirring. Next, 31.5 g of diethanolamine was diluted with 200 g of water, and the solution was added dropwise to the mixture over a period of 60 minutes. After stirring the resulting mixture for about 30 minutes, 18.8 g (0.1 mole) of 2-hydoxy-3-naphthoic acid was added to the mixture, followed by stirring at 90° to 95° C. for 2 hours. The reaction mixture was cooled to about 40° C. and then filtered. The product was washed with water until the pH of the washings was adjusted to neutrality, and was thereafter dried at 90° C., affording about 43 g of a pale yellow powder (Compound Example (2) given below).

PREPARATION EXAMPLE 3

Preparation of aluminum compound of 5-tert-butyl-salicylic acid (2:1 in acid/Al mole ratio) in the form of n-butylamine salt A 38.8 g (0.2 mole) quantity of 5-tert-butylsalicylic acid was added to a solution of 8 g (0.2 mole) of NaOH in 500 ml of water, and the mixture was heated to about 60° C. to completely dissolve the acid. An aqueous solution of 13.3 g (0.1 mole) of aluminum chloride in 300 ml of water was slowly added dropwise to the acid solution. The mixture was there-after stirred at about 90° C. for 30 minutes and then cooled to about 60° C. Subsequently, the reaction mixture was adjusted to a pH of about 10 with an aqueous NaOH solution. A solution of 7.3 g (0.1 mole) of n-butylamine in 100 ml of 1N aqueous hydrochloric acid solution was added dropwise to the mixture over a period of about 30 minutes. The resulting mixture was filtered, and the product was washed with water until the pH of the washings was adjusted to neutrality, and was thereafter dried at 90° C., affording about 46 g of a white powder (Compound Example (3) given below).

PREPARATION EXAMPLE 4

Preparation of aluminum compound of 1-hydroxy-2-naphthoic acid (3:1 in acid/Al mole ratio)

A 65.8 g (0.35 mole) quantity of 1-hydroxy-2-naphthoic acid was added to a solution of 20.4 g (0.1 mole) of aluminum isopropoxide in 300 ml of benzene, and the mixture was heated under reflux for 2 hours, then cooled to 30° C. The cooled reaction mixture was washed with small amounts of benzene and ether. The washed product was dried at 90° C., giving about 55 g of a pale yellow powder (Compound Example (11) given below).

Specific examples of aluminum compounds are given below.

| No. | Compound Example |
|---|---|
| (1) | 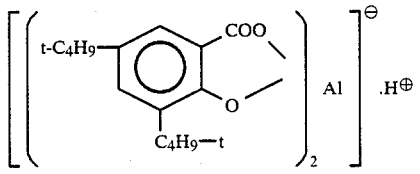 |

-continued
| No. | Compound Example |
|---|---|
| (2) | 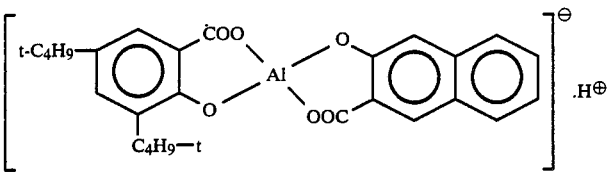 |
| (3) | 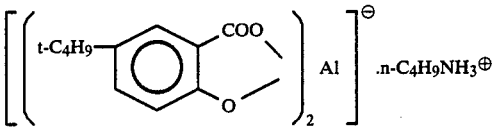 |
| (4) | 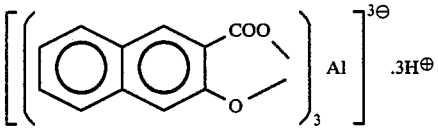 |
| (5) | 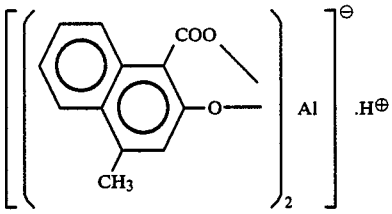 |
| (6) | 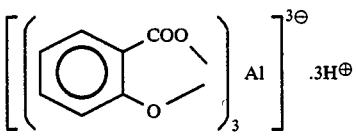 |
| (7) | 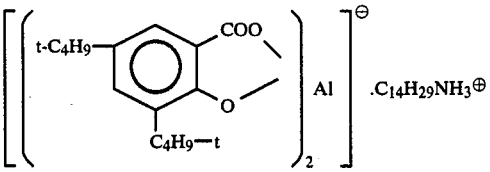 |
| (8) | 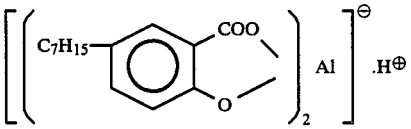 |
| (9) | 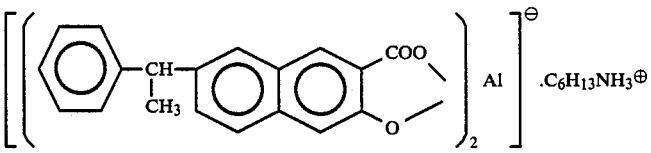 |
| (10) | 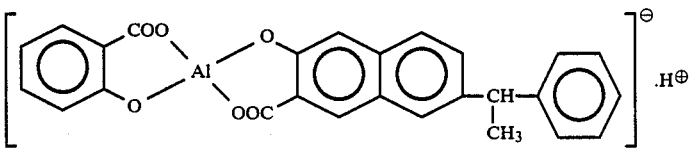 |

-continued

| No. | Compound Example |
|---|---|
| (11) | 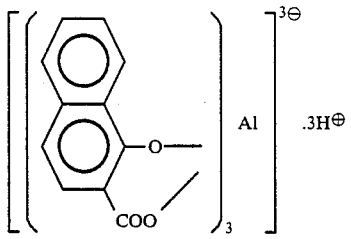 |
| (12) | 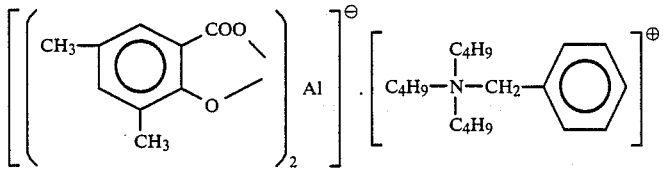 |
| (13) | 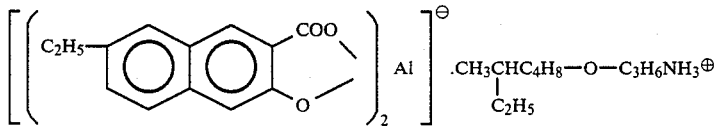 |

EXAMPLE 1

Polyester resin (product of Nippon Synthetic Chemical Co., Ltd.): 100 parts

Carbon black (product of Mitsubishi Chemicals, Ltd.): 7 parts

Compound Example (1): 1 part

The above ingredients were premixed uniformly by a high-speed mixer. The premix was then kneaded in a molten state by an extruder, cooled and thereafter roughly divided by an air jet mill equipped with a classifier, giving a black toner 10 to 20 μm in particle size.

A developer was prepared by admixing 95 parts of a particulate iron carrier (TEFV 200/300, product of Nippon Teppun Co., Ltd.) with 5 parts of the toner. The developer was −32.2 μC/g in the amount of initial blowoff charges. The amounts of blowoff charges at a low-temperature low-humidity condition (5° C., 30% rel. humidity) and high-temperature high-humidity condition (35° C., 90% rel. humidity) were −33.0 μC/g and −32.3 μC/g, respectively, which indicated high stability.

When the developer was used for a commercial selenium drum by the magnetic brush developing process, fog-free sharp black toner images were obtained with high thin-line reproducibility. The developer was used for making 50,000 copies continually, yet the toner images thereafter produced were still found to be free of degradation in quality.

EXAMPLE 2

Polyester resin (product of Nippon Synthetic Chemical Co., Ltd.): 100 parts

Blue dye (Valifast Blue #2606, product of Orient Chemical Industries, Ltd.): 5 parts Compound Example (2): 1.5 parts The above ingredients were treated in the same manner as in Example 1 to prepare a blue toner, and a developer was obtained similarly using the toner.

The developer was 21.5 μC/g in the amount of intial blowoff charges, and 21.3 μC/g and −18.9 μC/g in the amount of blowoff charges in a low-temperature low-humidity condition (5° C., 30% rel. humidity) and a high-temperature high-humidity condition (35° C., 90% rel. humidity), respectively. This indicates high stability. When used in the same manner as in Example 1, the developer produced distinct blue toner images free from any fog. The developer was used for making 50,000 copies continually, yet the toner images thereafter produced were still found to be free of degradation in quality.

EXAMPLE 3

Styrene-acryl copolymer (HIMER SMB600, product of Sanyo Kasei Co., Ltd.): 100 parts Red dye (Valifast Red #1306, product of Orient Chemical Industries, Ltd.): 7 parts Compound Example (5): 1 part The above ingredients were treated in the same manner as in Example 1 to prepare a red toner, and a developer was obtained similarly using the toner.

The developer was −17.8 μC/g in the amount of initial blowoff charges, and −19.6 μC/g and −15.2 μC/g in the amount of blowoff charges in a low-temperature low-humidity condition (5° C., 30% rel. humidity) and a high-temperature high-humidity condition (35° C., 90% rel. humidity), respectively. This indicates high stability. When used in the same manner as in Example 1, the developer produced distinct red toner images free from any fog and with high thin-line reproducibility. The developer was used for making 50,000 copies continually, yet the toner images thereafter produced were still found to be free of degradation in quality.

EXAMPLE 4

Styrene-n-butyl methacrylate copolymer resin (65/35): 100 parts

Benzidine Yellow (C.I. Pigment Yellow 12: 4 parts

Compound Example (3): 1 part

The above ingredients were treated in the same manner as in Example 1 to prepare a yellow toner, and a developer was obtained similarly using the toner.

The developer was −23.8 μC/g in the amount of initial blowoff charges, and −23.9 μC/g and −21.9 μC/g in the amount of blowoff charges in a low-temperature low-humidity condition (5° C., 30% rel. humidity) and a high-temperature high-humidity condition (35° C., 90% rel. humidity), respectively. This indicates high stability. When used in the same manner as in Example 1, the developer gave distinct yellow toner images free from any fog. The developer was used for making 50,000 copies in succession, yet the toner images therafter produced were still found to be free of degradation in quality.

EXAMPLE 5

Styrene-2-ethylhexyl methacrylate copolymer resin (80/20): 100 parts
Tri-iron tetroxide (EPT-500): 50 parts
Low-grade polymerized polypropylene (Biscal 550P, product of Sanyo Kasei Co., Ltd.): 4 parts
Compound Example (4): 2 parts The above ingredients were uniformly premixed by a ball mill to obtain a premix, which was then kneaded in a molten state at 180° C. using a twin-screw extruder (PCM-30, product of Ikegai Seisakusho Co., Ltd.), cooled, roughly crushed, pulverized and classified, giving a toner ranging from 5 to 15 μm in particle size. Two parts of the toner were admixed with 98 parts of a particulate iron carrier (TEFV 200/300, product of Nippon Teppun Co., Ltd.) to obtain a developer, which was found to be −20.1 μC/g in the amount of initial blowoff charges.

When the developer was used for a commercial copying machine (Canon NP201, product of Canon Inc.), fog-free images were obtained with good thin-line reproducibility and a reflection density of 1.4 at the solid image area.

EXAMPLE 6

Styrene-2-ethylhexyl methacrylate copolymer resin (80/20): 100 parts
Carbon black (product of Mitsubishi Chemicals, Ltd.): 7 parts
Compound Example (11): 2 parts The above ingredients were treated in the same manner as in Example 1 to prepare a black toner, and a developer was obtained similarly using the toner.

The developer was −18.9 μC/g in the amount of initial blowoff charges. The amounts of blowoff charges at a low-temperature low-humidity condition (5° C., 30% rel. humidity) and a high-temperature high-humidity condition (35° C., 90% rel. humidity) were −19.5 μC/g and −18.4 μC/g, respectively. This indicates high stability. When used in the same manner as in Example 1, the developer produced distinct black toner images free from any fog. The developer was used for making 50,000 copies continually, yet the toner images thereafter produced were still found to be free of degradation in quality.

The various corresponding other complex compounds contemplated herein are prepared and used in toner compositions in like manner to the analogous complex compounds in Preparation Examples 1 to 4 and use Examples 1 to 6.

ADVANTAGES OF THE INVENTION

The toner of the present invention is characterized in that the toner comprises an aluminum compound of aromatic hydroxycarboxylic acid which may be substituted with alkyl and/or aralkyl and which serves as a charge control agent. Due to the inclusion of such aluminum compounds of optionally alkyl and/or aralkyl substituted aromatic hydroxycarboxylic acids, the toner is triboelectrically chargeable uniformly with good stability and is outstanding in resistance to ambient conditions (resistance to moisture). During use, the toner remains free of degradation that could lead to variations or reduction in the amount of triboelectric charge and therefore has very high stability. Accordingly, the toner is usable without fogging, staining due to spillage and like objections. Whereas conventional toners have the serious problems of agglomeration, blocking and low-temperature flow during storage, the present toner can be stored for a prolonged period of time free of these problems to give sharp toner images which are excellent in abrasion resistance and amenability to fixing and adhesion.

Since the charge control agent is less likely to cause color disturbances, the present toner is usable for color electrophotography to produce copy images of excellent color.

While specific embodiments of the invention have been shown and described in detail to illustrate the appliction of the principles of the invention, it will be understood that the invention may be embodied otherwise without departing from such principles.

What is claimed is:

1. Negatively chargeable dry toner for developing electrostatic latent images, comprising 100 parts by weight of a binder resin and 0.1 to 10 parts by weight of an aluminum compound of an aromatic hydroxcarboxylic acid which is unsubstituted or substituted with alkyl and/or aralkyl.

2. Toner of claim 1 which comprises 100 parts by weight of said resin and 0.5 to 5 parts by weight of the aluminum compound.

3. Negatively chargeable dry toner for developing electrostatic latent images, comprising 100 parts by weight of a binder resin and 0.1 to 10 parts by weight of a charge control agent, said agent being a complex compound of aluminum and optionally alkyl and/or aralkyl substituted aromatic hydroxycarboxylic acid.

4. Toner of claim 3 wherein the complex compound is in the form of a complex with a counter ion.

5. Toner of claim 4 wherein the counter ion is hydrogen, $NH_4$, an ammonium ion of a primary, secondary or tertiary amine, or a quaternary ammonium ion.

6. Toner of claim 4 comprising 100 parts by weight of said resin and 0.5 to 5 parts by weight of the complex compound.

7. Toner of claim 3 wherein the complex compound has the formula $$[Al(Y)_a]^{b-} \cdot X^{+}{}_b$$

wherein each individual Y is an optionally alkyl and/or aralkyl substituted aromatic hydroxycarboxylic acid radical, X is a counter ion, a is 2 or 3, and b is 1 when a is 2 and b is 3 when a is 3.

8. Toner of claim 3 wherein the complex compound has the formula $$[Al(-O-Ar-COO-)_a]^{b-} \cdot X^{+}{}_b$$

wherein each individual Ar is an optionally alkyl and/or aralkyl substituted aromatic radical, X is hydrogen or $NR_4$ wherein each individual R is hydrogen, alkyl, alkoxyalkyl, cycloalkyl or aralkyl, a is 2 or 3, and b is 1 when a is 2 and b is 3 when a is 3.

9. Toner of claim 3 wherein the complex compound is a compound of aluminum and optionally alkyl and/or aralkyl substituted aromatic hydroxycarboxylic acid selected from the group consisting of salicylic acid, alkyl salicylic acid in which said alkyl has 1–12 carbon atoms, 3,5-dialkyl salicylic acid in which each said alkyl has 1–12 carbon atoms, 1-hydroxy-2-naphthoic acid, 2-hydroxy-3-naphthoic acid, 2-hydroxy-1-naphthoic acid, alkyl-2-hydroxy-3-naphthoic acid in which said alkyl has 3–12 carbon atoms, and 6-(alpha-methyl-benzyl)-2-hydroxy-3-naphthoic acid, and mixtures thereof, in the form of a complex with a counter ion.

10. Toner of claim 9 wherein the counter ion is hydrogen, $NH_4$, an ammonium ion of a primary, secondary or tertiary amine, or a quaternary ammonium ion.

11. Toner of claim 3 wherein the complex compound is selected from the group consisting of (1)

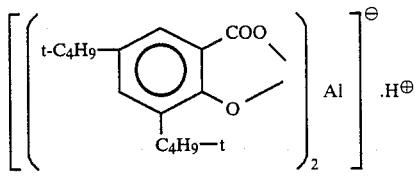

(2)

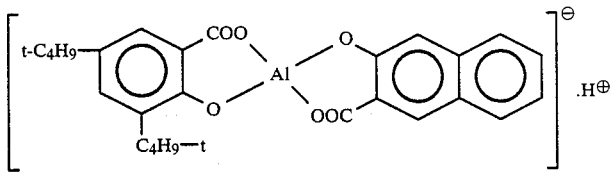

(3)

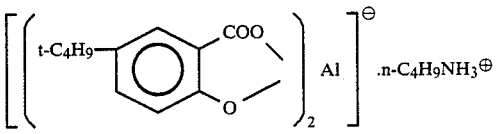

(4)

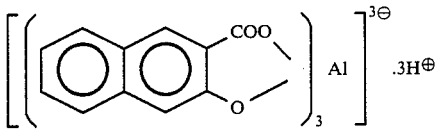

(5)

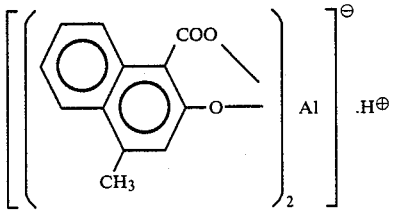

(6)

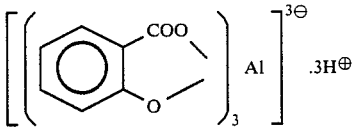

(7)

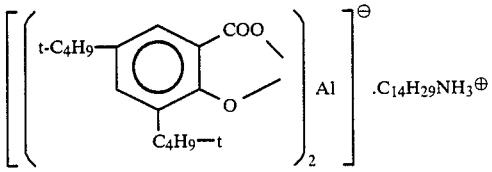

-continued (8)

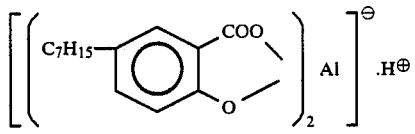

(9)

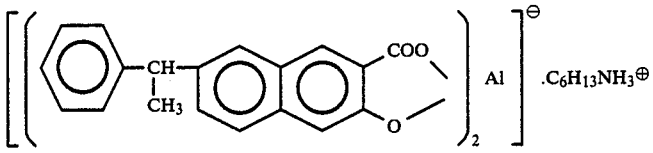

(10)

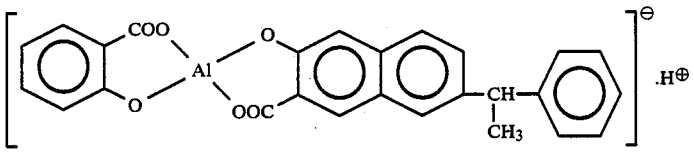

(11)

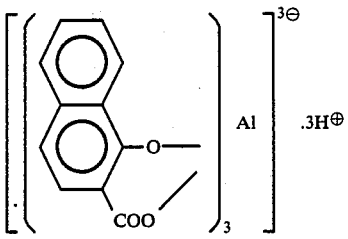

(12)

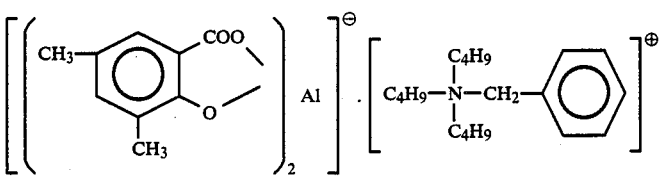

(13)

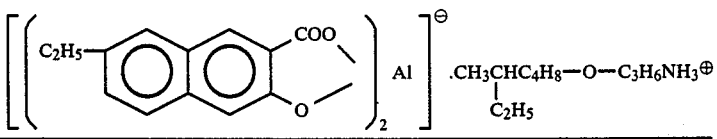

12. Negatively chargeable dry toner for developing electrostatic latent images, comprising 100 parts by weight of a binder resin and 0.1 to 10 parts by weight of a charge control agent, said agent being the product obtained by treating an aromatic hdyroxycarboxylic acid which is optionlly substituted with alkyl and/or aralkyl in aqueous, alkaline or non-aqueous solution with an aluminum imparting agent, and precipitating and recovering therefrom the corresponding compound of aluminum and the aromatic hydroxycarboxylic acid thereby formed as the reaction product.

* * * * *